US005452487A

United States Patent [19]

Leggett

[11] Patent Number: 5,452,487

[45] **Date of Patent: * Sep. 26, 1995**

[54] INSULATED PUNCTURE RESISTANT INFLATABLE MATTRESS

[76] Inventor: Dennis V. Leggett, 7109 Sontag Way, Springfield, Va. 22153

[ * ] Notice: The portion of the term of this patent subsequent to Jul. 19, 2011 has been disclaimed.

[21] Appl. No.: 276,463

[22] Filed: Jul. 18, 1994

Related U.S. Application Data

[63] Continuation-in-part of Ser. No. 985,194, Dec. 3, 1992, Pat. No.5,329,656.

[51] Int. Cl.[6] ..... A47C 27/08

[52] U.S. Cl. ..... 5/450; 5/420; 5/481; 5/476; 5/458

[58] Field of Search ..... 5/413, 420, 449, 5/450, 451, 454, 458, 471, 476, 481, 644, 900.5; 297/DIG. 3, 284.6

[56] References Cited

U.S. PATENT DOCUMENTS

| | | | |
|---|---|---|---|
| Re. 31,898 | 5/1985 | Suter | 5/449 X |
| 3,533,113 | 10/1970 | Stamberger | 5/454 |
| 3,798,686 | 3/1974 | Gaiser | 5/420 X |
| 3,872,525 | 3/1975 | Lea et al. | 5/451 X |
| 3,877,092 | 4/1975 | Gaiser | 5/413 X |
| 4,039,363 | 8/1977 | Robertson | 297/DIG. 1 X |
| 5,023,128 | 6/1991 | Fatool | 5/449 X |
| 5,117,517 | 6/1992 | Su | 5/450 |
| 5,303,435 | 4/1994 | Haar et al. | 5/420 X |
| 5,329,656 | 6/1994 | Leggett | 5/420 X |

FOREIGN PATENT DOCUMENTS

| | | | |
|---|---|---|---|
| 1299789 | 12/1972 | United Kingdom | 297/284.6 |

*Primary Examiner*—Michael F. Trettel
*Attorney, Agent, or Firm*—Stephen Gates; Glenna Hendricks

[57] ABSTRACT

An inflatable enclosure useful as a matress is described which has first (bottom) and second (top) broad surfaces connected at their edges to form the enclosure, the bottom being formed of a substantially air-impermeable resilient closed-cell foam wherein the thickness and density of the closed-cell foam has been selected to provide semi-rigid characteristics between adjacent points of support and the top being formed of material selected from an air-impermeable resilient closed-cell foam and a flexible air-impervious material, said first surface being connected around its edges to a flexible air-impervious material which is in turn attached around the edges of the second surface to form the enclosure, the enclosure having at least one closable means for admitting a fluid to and releasing fluid from the enclosure.

12 Claims, 4 Drawing Sheets

INSULATED PUNCTURE RESISTANT INFLATABLE MATTRESS

This application is a continuation-in-part of U.S. patent application 07/985,194, filed Dec. 3, 1992, now U.S. Pat. No. 5,329,656.

FIELD OF THE INVENTION

This invention relates to improved lightweight inflatable mattresses.

BACKGROUND OF THE INVENTION

Individuals typically require a comfortable surface, or mattress, on which to recline while sleeping or resting. In particular, individuals involved in activities such as camping and backpacking need a mattress which is portable, lightweight, puncture resistant, inflatable or self-inflatable, insulating, and comfortable. Smaller units may be used as pillows. Further, lightweight portable mattresses find use in many other areas.

Mattresses intended for camping and backpacking have used a number of approaches to obtain these properties. They include: a) basic chambered air mattresses; b) simple thin resilient insulating pads; c) open-cell resilient foam pads (typically 1 to 2 inches thick); and d) a variety of insulated air mattresses.

Each of these approaches has been found deficient in one or more aspects. Basic chambered air mattresses provide very little insulating benefit and require an excessive amount of time and effort to inflate. Thin pads fabricated from natural resilient materials tend to be relatively heavy and provide very little cushioning benefit. Thin pads made from synthetic materials, such as closed-cell vinyl-nitrile (Ensolite), ethylene-vinyl acetate (EVA), or polyethylene foam, reduce weight but provide only a limited comfort benefit. Pads made from thermoformed closed-cell foams are described in U.S. Pat. No. 4,980,936 to Frickland et al. That patent also presents extensive background material on the use of foamed pads. Although closed-cell foam pads could be made thicker, this would increase weight and reduce portability.

Portable pads formed of resilient open-cell foam sheets, such as polyurethane are typically 1.0 to 2.5 inches thick. This resilience and increased thickness makes the pad somewhat more comfortable at the expense of increased weight and bulk.

Thereafter, inventors created several versions of insulated air mattresses. These designs completely or partially filled an air-impervious air mattress cover with resilient insulating materials. One such approach to providing a self-inflating foam filled air mattress is disclosed in U.S. Pat. No. 3,798,686. In this patent the resistance of the foam core to compression is utilized to give the air mattress its self-inflating characteristic. The foam core shown in this patent comprises upper and lower continuous sheets of open-celled foam, between which two layers of crossing foam ribs are configured. The foam components are all bonded to one another, and the entire structure is enclosed within a flexible cover, preferably of an air-impervious nylon type. The limited number of spaced 0.75 inch width rectangular foam ribs on 2.5 inch centers together with stress caused by low superatmospheric pressure, generates higher stress levels at the edge of the bonds than at areas towards the center of each bonding area. This unequal utilization of the ribs' tensile strength properties increases overall weight and the probability of bond delamination or rib tearing beginning at the rib edges and progressing towards the center of each bond. Compensatory measures such as increasing rib or bond strength leads to increased weight and/or costs. This design relies upon the upper and lower continuous sheets of open-cell foam for much of its insulating benefit. When rolled, the areas under the longitudinal (lengthwise) ribs are significantly bulkier than adjacent areas, leading to a greater than necessary overall rolled size.

U.S. Pat. No. 4,688,283 to Jacobson, et. al. discloses a multi-chambered mattress which utilizes an open-cell foam within a air-impervious nylon cover. The mattress is divided along its length into multiple chambers with differing thicknesses of foam. The significant quantity of open-cell foam materials together with the air-impervious cover leads to the weight penalty associated with both of the preceding designs.

U.S. Pat. Nos. 4,025,974 and 4,624,877 to Lea, et al. disclose a single chamber design which encloses a single slab of open-cell foam. The patentees laminate the top and bottom surfaces of an open-cell foam to the inside of a cover made of an air-impervious plastic-coated fabric. This foam-to-cover bond reduces displacement ("ballooning" or "billowing") of the covers and enables better pressure management. Billowing occurs when top and bottom covers are inadequately linked mechanically to each other and are free to expand from one another. Unless it is limited properly, this billowing creates an unstable surface and provides inconsistent support for the user. As with the other self-inflating insulated air-mattresses described above, the use of a solid insulating open-cell foam sheet and separate air-impervious cover components significantly increases mattress weight. Unless done with great care, perforation of the open-cell foam sheet to reduce weight may act to; a) reduce insulation; b) lead to destructive delamination between the foam sheet and the cover element where the remaining foam or bonding area is unable to sustain the load placed upon it; and c) diminish the mattress's horizontal dimensional rigidity. The insulation value of the open-cell foam sheet is critical since the cover does not provide significant insulating value. In U.S. Pat. No. 4,025,974 at Column 10, lines 14–19 and at Column 11, lines 40–47 it is stressed that it is necessary to bond the cover to the foam-sheet along substantially the entire horizontal surface because there is a tendency when a small area of non-bonding bonding or delamination occurs in an area where the skin is tensioned outwardly for this delamination to spread progressively, even under moderate pressure. Given the inflated profile of the cover and open-cell foam sheet when bonded together, perforation of the open-cell foam sheet of U.S. Pat. No. 4,025,974 would accelerate the delamination process. While the bond between the foam and cover could be strengthened through use of an improved adhesive, the necessity of bonding the entire foam surface to the cover could significantly increase cost and weight. Because of the flexible nature of the air-impervious cover, this design relies upon the open-cell foam sheet for the dimensional rigidity necessary for proper inflation. More recent designs have utilized foam sheets with transverse circular perforations or tubular voids running horizontally through the foam sheet. This approach leaves substantially continuous thin foam layers along all of the inside bottom and top mattress covers, inter-connected by foam material or ribs. The thin foam layer imparts the dimensional rigidity necessary to support the cover between adjacent ribs. The ribs are on approximately 2.75 inch centers and are approximately the same width as that of the longitudinal void spaces remaining between the horizontal tubular voids. While the ribs run in only one direction and the fabrication approach differs, this design shares common features with the previously referenced U.S. Pat. No. 3,798,686. The thin layers of foam left at the top and bottom of the foam sheet over the tubular voids increase the relative load bond area resisting delamination at the expense of increased fabrication complexity and expense. While increasing bond area, this approach makes inefficient use of the foam and fabric coating (or adhesive) tensile strength, focusing the greatest stress along the outer edges of each foam rib (and associated bond) and relatively lower stress towards the center of each foam rib.

As additional background information, other examples of foam filled structures are disclosed in the following patents: British Pat. No. 984,604; Brawner U.S. Pat. No. 1,159,166; Nappe U.S. Pat. No. 2,834,970; Lerman U.S. Pat. No. 3,323,151; Cornes U.S. Pat. No. 3,378,864; Kain U.S. Pat. No. 3,537,116; and Gottfried U.S. Pat. No. 3,611,455. In U.S. Pat. No. 4,092,750 a metallized film is used in the mattress's interior for added insulation.

Even with the use of tough coated synthetic fabrics, these mattresses are susceptible to punctures. A foreign object only has to penetrate between fabric strands to puncture the very thin polymer coating. Previous designs have focused upon the use of very thin materials, typically in the range of about 4 mils to about 15 mils. When such a mattress is punctured, air pressure is lost, and the mattress's support is reduced or lost completely.

Finally, the mattress's comfort is limited by the fully sealed nature of the mattress. This limits the mattress's ability to respond to changing conditions, such as switching from lying on one's back to lying on one's side. One example of an attempt to eliminate this limitation is presented in U.S. Pat. No. 4,328,083 to Lineback. This approach locates one or more resilient subchambers within the confines of the larger air mattress envelope. When force is applied to the air mattress, the enclosed fluid presses against the resilient subchambers. Being open to the atmosphere, these chambers deform, releasing air to the atmosphere, thereby partially releasing pressure within the primary chamber. The fixed resilience of these subchambers restrict the ability of the air mattress to respond to individuals with differing weights and to individual preferences.

The present invention overcomes the weight, comfort, and puncture problems associated with prior insulated air mattresses. Relatively thick air-impervious foamed material is used in place of at least one of the prior thin fabric or plastic sheet materials to provide at least one surface which generally is used as the bottom surface of the cover or enclosure. This approach enables one component to provide air-imperviousness, insulating, puncture resistance, and dimensional rigidity functions leading to an overall weight reduction. Weight is further reduced through the use of internal resilient material configurations which provide a high degree of void space. The corresponding decrease in bond area enables the use of stronger bonding agents to bond the resilient materials to the covers without an overall increase in cost. Optionally, bond strength is enhanced through the use of sculptured bonding surfaces to equalize tension across the bond. Optionally, mattress dimensional rigidity may be increased through the configuration of additional separately inflated chambers in the interior of the mattress. Optionally, comfort is enhanced by a configurable subchamber filled with resilient material configured such that the controlled release of internal mattress pressure is enabled when a force is applied to the mattress.

While the prior art has recognized the value of a wide range of design features, in the present invention those properties are utilized in combination and in select configurations to: a) reduce the stored volume of the internal resilient materials; b) maintain reliability as the quantity of resilient material is reduced; c) increase comfort across a broader range of mattress configurations; d) optimize the performance of the relatively thick air-impervious foamed material when used in self-inflating application; e) enhance self-inflation and largely self-inflating operation; and f) reduce overall weight.

SUMMARY OF THE INVENTION

Accordingly, several objects and advantages of my invention arise from a novel mattress construct which provides a mattress combining insulation, air-imperviousness, and structural integrity in one component. Associated refinements enable: enhanced self-inflation operation after storage; enhanced displacement control module/bond tensile strength management; reduced relative stored volume; enhanced comfort characteristics; and reduced weight. The present invention comprises an insulated mattress which is a substantially fluid-impervious inflatable enclosure, at least one broad surface or side of which is formed using a relatively thick insulating material, in particular a resilient semi-rigid closed-cell foam, having a closable means such as a valve or stopper for admitting to and releasing from the enclosure a fluid such as air, water, or the like which also permits varying the quantity of enclosed fluid. When the closable means is opened, air or other liquid is introduced to inflate the mattress. Closure maintains the mattress in the inflated mode. In a preferred embodiment the mattress contains sufficient compressible resilient units attached to the inner surfaces of the enclosure to cause the enclosure to self-inflate when a fluid is admitted to the enclosure and substantially reduce billowing of the enclosure under pressurized conditions.

In one embodiment, the relatively thick air-impervious cover material is modified to facilitate self-inflation. Modification techniques include, but are not limited to, replacement of selected cover elements with a thin air-impervious material and densification of selected areas of the cover material.

In another embodiment the invention provides a mattress which provides increased internal bond reliability by using the resilient materials in such a manner that the tensile properties of the resilient materials are more fully utilized. One approach pre-contours the bonding surfaces of the resilient inflation/displacement control modules and/or the insides of the covers. Selected embodiments provide module width and intermodule spacing such that simple uncontoured bonding surfaces bonds between the module and covers are sufficient to reliably resist tearing.

In another embodiment, the invention provides a mattress which has a smaller relative volume when stored by distributing the internal resilient materials in orientations such that the quantity of resilient material across the stored width of the mattress is roughly equalized thereby avoiding resilient material concentrations which would otherwise increase stored bulk. Another embodiment of the invention uses a mix of thin fabric or plastic sheet and resilient material-based control members to obtain the benefits of both. Another embodiment of the invention provides a mattress with increased user comfort and mattress reliability by providing a user configured pressure control chamber. Another embodiment of the invention provides a mattress which increases user comfort by providing a user configured lumbar support assembly. Another embodiment of the invention provides a mattress with vertically stacked independent air-impervious chambers. Another embodiment of the invention provides a mattress with improved self-inflation characteristics through inclusion of one or more small subchambers, with a fluid source independent of that for the main mattress chamber, structured in such a fashion as to cause the mattress cover to unroll and/or increase the cover's rigidity when a quantity of fluid less than that necessary to fully inflate the mattress is admitted to the subchamber(s). Still further objects and advantages will become apparent from a consideration of the ensuing description and drawings.

DETAILED DESCRIPTION OF THE INVENTION

Figure 1A:
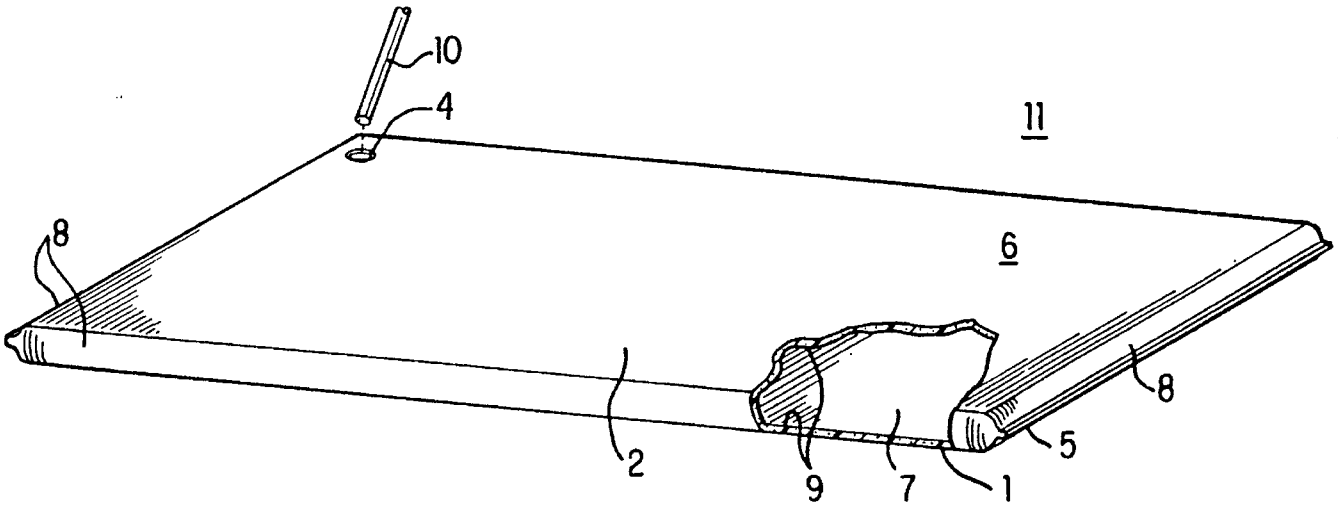
FIG. 1*a* shows a cutaway view of the internal structure of a mattress of the invention.

One embodiment of the invention is illustrated in FIG. 1*a*. The mattress 11 consists of first (bottom) and second (top) cover elements or surfaces 1 and 2 having edge connections 5 to form a substantially fluid-impervious flexible enclosure. At least one of the top and bottom cover elements, usually the lower surface 1, is formed of a relatively thick, puncture resistant, air-impervious, resilient semi-rigid closed-cell foamed material. In a preferred form of the invention both covers 1 and 2 are made of such a material. The term "resilient semi-rigid closed-cell foam" as used herein means a semi-rigid closed-cell foam which has sufficient rigidity to be substantially self-supporting supporting between two support points and will withstand a 180° mandrel bend and substantially return to its original form. Appropriate cover materials include, but are not limited to, resilient semi-rigid closed-cell foams of polyethylene, ethylene-vinyl acetate (EVA), blends of ethylene polymers and/or copolymers, acrylic, PVC, polyurethane, natural or synthetic rubber and the like. Typically the thickness of the cover may range from about 1/16 inch or less to about 3/8 inch or more. Typically the densities of commercially available materials vary from about 1.2 to about 6 lb/ft$^3$. Some are offered, and may be used, with high-friction or textured surfaces, skin-like surfaces, fiber reinforcement, or have been bonded to other plastic sheeting or fabrics. Commercial products such as Epilon® (Youngbo America) and Volara® (Voltek), cross-linked ethylene polymer foams having a density of about 2 lb/ft$^3$ bonded to various reinforcement or wear layers, have been found to be suitable for the purposes of the invention. The thickness of covers of the invention should be contrasted to typical covers of the prior art which range from about 4 to 15 mils thick. The increased thickness and the inherent toughness of the closed-cell foam cover or covers of the mattress of the present invention significantly improve the mattress's resistance to punctures, and provides enhanced insulating capabilities, while the semi-rigid nature of the cover imparts the horizontal dimensional rigidity required for dimensional stability of the mattress. The relatively thick air-impervious layer resists punctures even when foreign objects have partially penetrated the cover. A valve assembly, plug, cap, or equivalent closure 4 is used to enable the controlled exchange of fluid (air, water, etc) between the enclosed volume of the mattress and the atmosphere.

When the mattress is stored in a rolled form or folded for several hours, the closed-cell foam material may experience a "memory" effect. This characteristic slows the closed-cell foams return to its natural flat profile. This memory effect is greatest along the edges (when a single sheet is used to form top, bottom, and sides of the mattress) or along mattress folds.

Figure 6B:
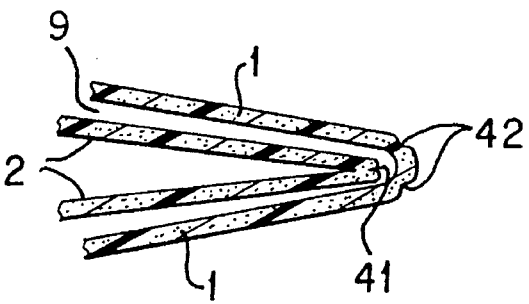
FIGS. 6*a* and 6*b* show alternative configurations which facilitate self-inflation.
Figure 6A:
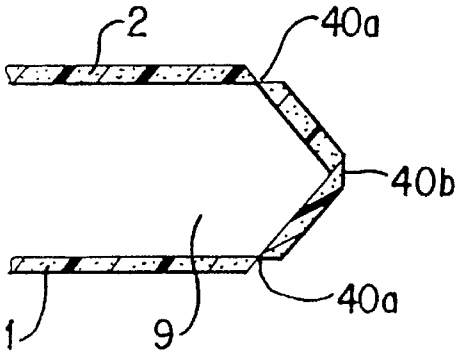
Figure 7:
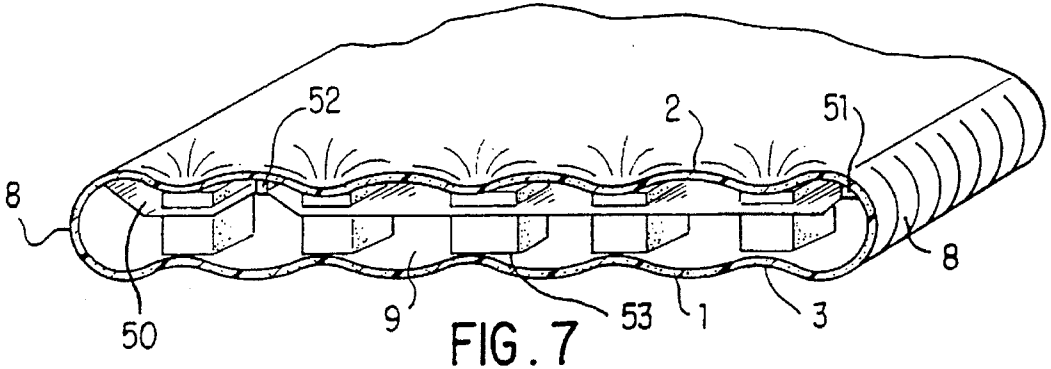
FIG. 7 shows a mattress having an optional lightweight sheet or baffle enclosed within the mattress to further increase its insulating properties.

Referring to FIG. 6*a*, the memory effect may be reduced and self-inflation facilitated by densifying the foam or substituting a thinner foam as shown at 40*a* and 40*b*, or substituting relatively thin air-impervious material for an entire side, usually the top 2, or may be limited to sides 8, or very narrow (about 1/8 inch) longitudinal strips 40*a* and/or 40*b* in the side walls 8. This creates a hinge effect between the top surfaces and side walls. Folding may be substituted for rolling to minimize the memory effect in those areas other than in the immediate area of the fold. Referring to FIG. 6*b*, one or more very narrow strips (about 1/8 inch) 41 along the expected fold line may be densified and/or replaced with another relatively thin air-impervious material on the surface which will be hidden after folding. This may also be applied one or more times on the opposite cover surface 42 in the area of the fold. This creates a hinge effect facilitating folding and unfolding. The mattress may be folded after manufacture to create this hinge effect utilizing the foam's memory. Typically a back and forth accordion fold may be used. Six to eight folds will yield a stored size of between about 9 inches and 12 inches for a 72 inch long mattress. Alternately the side walls may be thermoformed into the appropriate inflated profile. Each of the alternate configurations retain the beneficial characteristics obtained by utilizing the subject foamed air-impervious material as the bottom cover surface 1.

Figure 8:
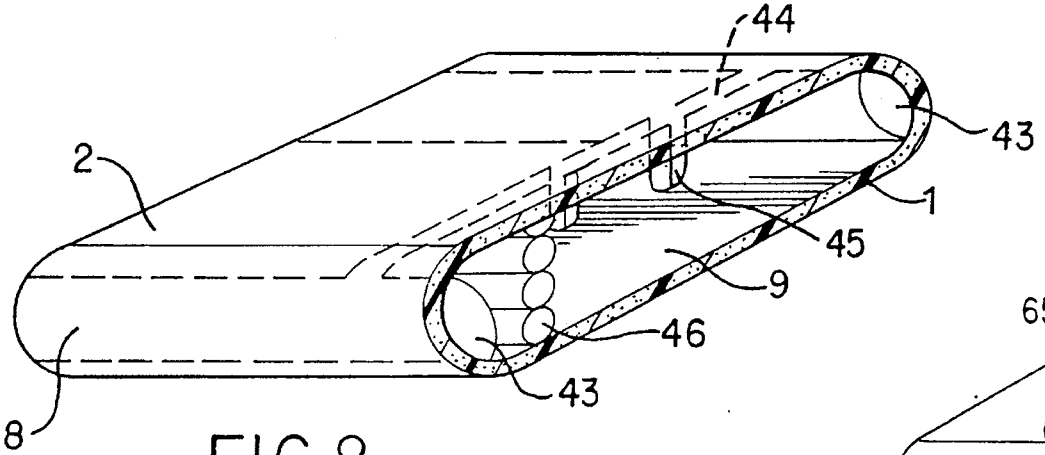
FIG. 8 shows a cutaway view of a mattress which contains a number of subchambers.

Referring to FIG. 8, self-inflation may also be facilitated by including at least one relatively small internal subchamber 43 in the enclosure structured in a manner to cause the mattress cover to unroll and/or increase the cover's dimensional rigidity when a quantity of fluid less than that necessary to fully inflate the mattress is admitted. These subchambers 43 may extend along the length of the mattress, inter-linked by one or more transverse subchambers 44. The subchamber may be provided with vertical protrusions 45 or may be wider in the vertical dimension 46 which act to cause the bottom 1 and top covers 2 to separate upon the admission of a relatively small quantity of fluid. The subchamber(s) 44 may be physically attached to the covers 1 and 2 or positioned between other internal mattress components to avoid undesired subchamber shifting. The size of subchambers and interchamber spacing will be affected by the intended application, available fluid pressure, the cover material being supported, and the degree of rigidity desired in the mattress. Inter-chamber spacing would be reduced for more flexible cover materials and for applications requiring greater rigidity or surface flatness.

Figure 1B:
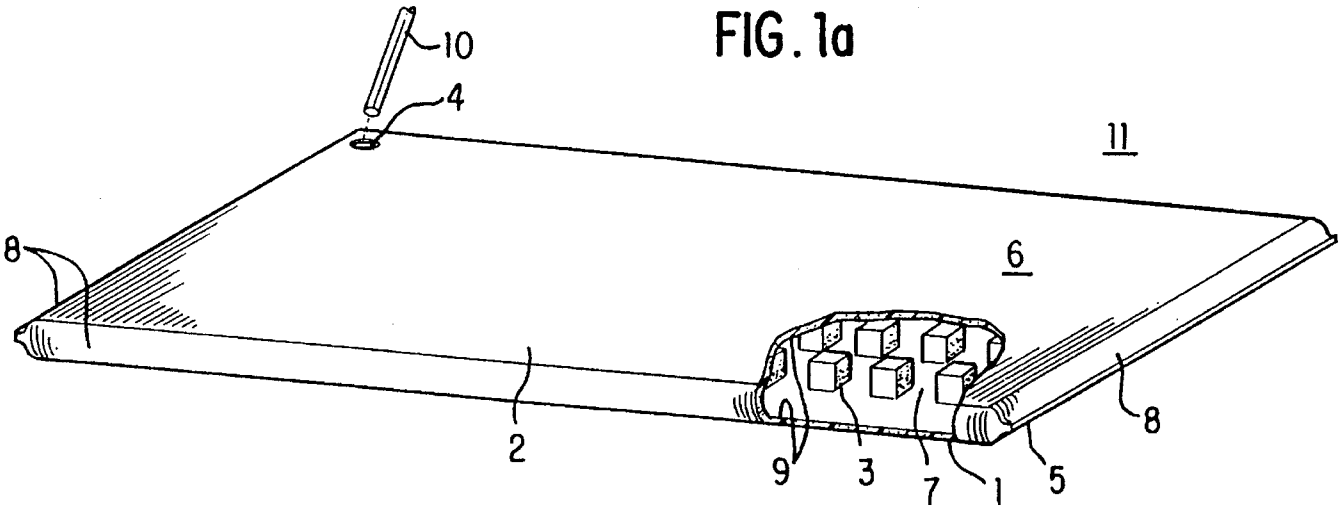
FIG. 1*b* shows a cutaway view of the internal structure of a mattress which contains a number of inflation/displacement control modules.

In a preferred embodiment of the invention shown in FIG. 1*b* a mechanism 3 is provided to force the covers 1 and 2 apart and cause self-inflation of the mattress. In prior art constructions either a separate frame, or a substantially continuous internal surface pressing against the inside of the cover, has been required. Due to the semi-rigid (horizontal dimensional rigidity) nature of one or both of the covers 1 and 2, it is only necessary to apply force at discrete points throughout the interior surfaces 9 of the mattress to separate the covers 1 and 2 and cause self-inflation. Use of the previously described air subchambers 43 (FIG. 8) to increase dimensional rigidity for covers formed from flexible fabric or plastic sheets will enable increased separation between supports. A light weight material having a density in the range of about 0.8 to 1.8 pounds per cubic foot such as an open-cell foam (polyurethane or polyether foam, neoprene polymer foam, low density polyethylene foam, ethylene copolymer foam, polyisoprene sponges, or the like), springs, or bonded fibers is preferred.

Figure 3A:
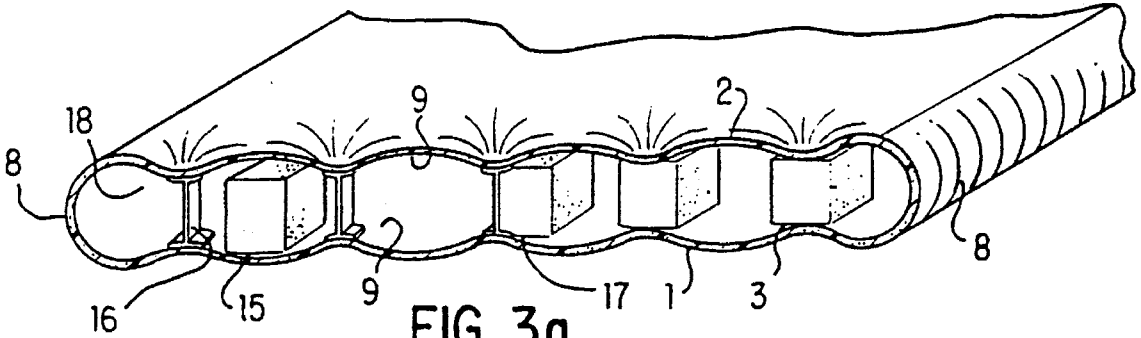
FIGS. 3*a* and 3*b* show the profile of a mattress of the invention when inflated and show a number of alternative inflation and/or displacement control mechanism configurations.

Cover displacement is limited by mechanically linking the bottom and top covers 1 and 2. A number of configurations may be used to link the bottom and top covers 1 and 2. Several alternatives are shown in FIG. 3*a*. The preferred configuration combines cover displacement and self-inflation functions in a single inflation/displacement control module 3 made from any of the light-weight resilient materials described above and bonded to the interior sides 9 of the covers 1 and 2. When used as a combined inflation displacement control module, the material for the module is selected to provide sufficient tensile strength to restrain the covers for displacement control and sufficient resilience to have the compression and expansion properties necessary for the inflation functions. The elasticity of the inflation/displacement modules and several of the available cover materials enables the mattress volume to effectively increase in response to sudden pressure surges thereby reducing bond failures between the control modules 3 and the inside surfaces 9 of the covers. Typical maximum elongation values for open-celled polyurethane foams range from 125% to 250% of original thickness.

Figure 3B:
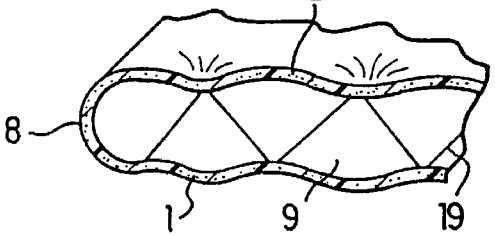
Figure 2:
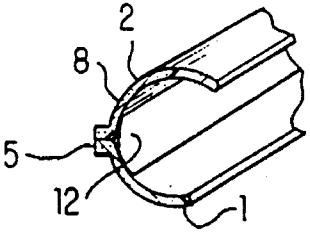
FIG. 2 shows an optional edge reinforcement strip for the seams of the mattress of the invention.

In another embodiment a flexible component 16 made of fabric or plastic sheeting may be used to limit/control separation of the covers 1 and 2. The displacement limiting components 16 are distributed throughout the interior of the mattress and thermally or adhesively bonded to the interior sides 9 of the bottom and top covers 1 and 2. The fabric or plastic sheeting component 16 may take the form of the I-beam shown in FIG. 3*a* or a simple [shape in which the top and bottom elements are bonded to the interior cover surfaces, or a single sheet 19 (FIG. 3*b*) alternately bonded to the interior of the top 2 and bottom 1 surfaces to form alternating upright and inverted V profiles, a circular tufted structure or a similar construction. The V profile 19 creates air breaks or barriers which reduce internal convection currents. In this approach, a separate resilient inflation component 15 (see FIG. 3*a*) or a subchamber 43 (see FIG. 8) is provided to force the two covers 1 and 2 apart. Alternately the self-inflation and displacement control mechanisms may be bonded to one another as illustrated by 17 (FIG. 3*a*). The displacement control mechanism may be wrapped completely around the self-inflating mechanism leaving space for the admission of fluid from the interior of the mattress. The displacement control mechanism 17 is then bonded to the interior sides 9 of the covers. A mix of resilient and fabric or plastic sheeting displacement limiting modules may be used to obtain the benefits of both.

Figure 4C:
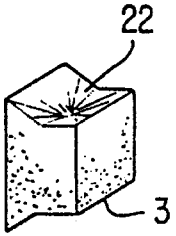
FIGS. 4*a*, 4*b*, 4*c*, 4*d*, and 4*e* show a number of alternative optional shaped or contoured bonding surfaces which may be utilized on small spot, narrow elongated strip foam, perforated sheet, and formed/machined sheet inflation/displacement control module configurations.
Figure 4B:
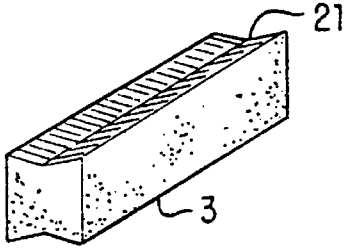
Figure 4E:
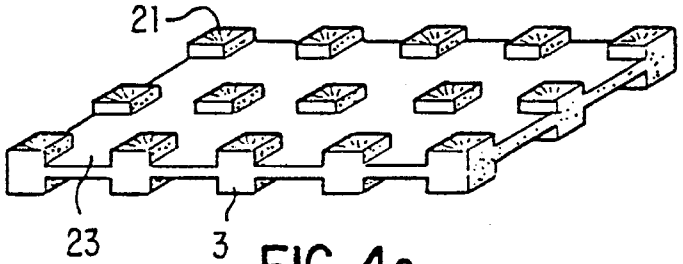
Figure 4A:
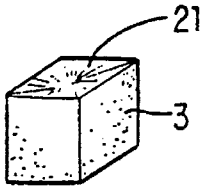
Figure 4D:
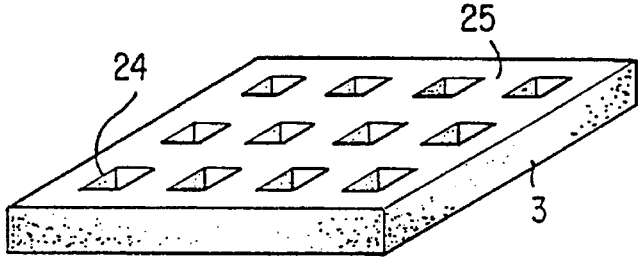

Use of a preferred combined inflation/displacement control module 3 minimizes the number of components required to enable self-inflation and displacement control functions. The resilient modules 3 serve to first force apart and then maintain or stabilize the displacement between the two covers. FIGS. 4*a–e* present several expanded views of alternative individual resilient inflation/displacement control modules 3. While square and rectangular (in the horizontal dimension) modules 3 and cutouts 24 are represented, many shapes are appropriate including circular and oval, long straight or serpentine strips, and the like. The choices are limited only by the ingenuity of the designer. Displacement control module configurations which equalize stress across the entire module and bond cross-section increase reliability and reduce weight. Contoured bonding surfaces 21 of the modules 3 optionally may be used to equalize the stress across the entire bonding cross-section of the module. When this approach is used, the surface slope 21 is selected to match the wave profile of the inflated cover as shown in FIG. 3*a*. This stress equalization eliminates localized areas of excessive stress which might lead to bond edge peel and subsequent bond failure between the module 3 and the inside cover surface 9 or to tearing the module. Alternatively some or all of the contouring may be done to the bonding areas of the inside cover surface 9 rather than just to the module(s) 3. The contouring may be accomplished by means such as thermoforming, molding, surface machining and the like. FIG. 4*c* shows a contour 22 which may be used for locations where the displacement or separation between the upper and lower mattress surfaces is varied as in a contoured mattress. This contour equalizes stress across the displacement change region. FIG. 4*d* presents a construction utilizing a perforated resilient sheet 25 in place of the several inflation/displacement modules 3. The perforations may have any form such as circular, square, or rectangular or the like, and may pass partly or completely through the sheet, and may be in an horizontal or vertical form leaving adequate material for the inflation and, where intended, displacement control functions. The material of the perforated sheet 25 which remains between the perforations 24 may be contoured to equalize stress across the bonding surface when the foam is to be adhered to the inside 9 of the bottom 1 and top 2 covers. FIG. 4*e* shows another construction which utilizes a sheet of open-cell foam or other suitable material 23. Modules 3 may be formed or machined as part of sheet 23 or bonded to the sheet 23. Sheet 23 reduces convection currents within the mattress enclosure. The single unit form shown in FIGS. 4*d* and 4*e* may be utilized to advantage during manufacturing to facilitate assembly.

The spacing of the resilient modules (or perforated sheet void spaces) is influenced by a number of factors. Placement of the displacement control modules is principally determined by: a) the external forces which are expected to be applied to the mattress which determine the internal pressure which must be handled and therefore the strength of the cover materials, modules 3, and their associated bond; b) the degree of billowing (or ballooning) of the cover which is acceptable; c) whether contoured or flat module bonding surfaces are to be used; and d) whether self-unrolling is to be facilitated. For a typical air mattress for use in camping and the like which may have a width of 20 to 25 inches, intermodule (on center) spacing of less than about 5 inches has been found to be effective. As intermodule spacing is reduced billowing of the cover surface(s) decreases. In general, comfort usually increases as intermodule spacing is reduced. An intermodule spacing of about 1 to 2.5 inches has been found to provide an effective balance between cover billowing and manufacturing complexity. In a typical camping mattress this works out to about 8 to 20 rows of modules. Module width generally may be decreased as the number of modules increases.

Relatively large numbers of very narrow displacement control modules (less than about ½ inch for sleeping mattresses) reduce the need for bonding surface contouring. For instance, four ¼ inch wide strips on 1 inch centers may be substituted for one 1 inch wide contoured strip on a 4 inch center. Each strip carries a relatively smaller portion of the overall tension between the bottom and top cover 1 and 2 elements. As the spacing decreases, cover distortion, or rounding of the surface also decreases. Further, as the module width is reduced, the relative quantity of material at the center of the module is reduced relative to the edge materials. The ability of the resilient materials to elongate (stretch) when placed under tension serves to equalize the remaining stress imbalances across the module's cross-section. During storage the relatively narrow modules tend to buckle when compressed spreading themselves over a wider area leading to a smaller stored thickness.

Other module configurations will be affected by the method of application, material characteristics, and the desired inter-module spacing. Thus although the size and number of these modules is dependent upon the material selected, the intended application, desired reliability, and associated assembly effort, the size and number for a particular application may be determined readily by routine experimentation. For the camping mattress application described above, when using open-cell polyurethane foam, the preferred module bonding surface 21 (FIG. 4*a* and 4*b*) size will be approximately 1 to 4 square inches (each end) for contoured discrete modules; 0.1 to 1 square inch (each end) for uncontoured discrete modules; approximately 0.675 to 1.25 inch wide for relatively long contoured strips; or 0.1 to 0.5 inch wide for uncontoured relatively long strips.

Where relatively long strip modules are utilized, the strip's orientation relative to the mattress length has a significant impact upon the mattress's rolled size and upon the ability of the mattress to self-unroll. In general, a longitudinal orientation maximizes the ability of the mattress to self-unroll. When rolled, the longitudinal resilient material is concentrated in a portion of the mattress' rolled width, thereby increasing the mattress' rolled diameter. Transverse orientation of the strips across the mattress width reduces the rolled size at the expense of reduced self-unrolling capability (except where relatively wide blocks or semirigid covers are used, increasing overall weight). Orientations selected somewhere between longitudinal and transverse provide the best balance between self-unrolling and rolled size. These orientations distribute the resilient material across the stored mattress. Configurations with a moderate serpentine pattern have been found effective for application as a portable mattress. Serpentine patterns which repeat more frequently (every few inches) have also been found effective. Where the strips are constructed to naturally retain their pattern, frequent orientation changes provide additional module dimensional rigidity reducing material mis-orientation during construction. Experimentation has indicated that patterns which vary the strip's orientation such that the strip is offset by as little as ¼th its width at any point along its length provides a related benefit. Where discrete modules are utilized, placement is selected to distribute the resilient material across the rolled-up or folded mattress when stored. Where storage will involve folding, the modules are positioned such that their distribution is generally equal when folded.

Beginning with a rolled (stored) mattress, the method of operation is as follows. The user places the rolled mattress on the ground, opens valve 4, and unrolls the mattress. Mattresses utilizing resilient strips rather than rows of resilient modules will more readily unroll on their own. Folded mattresses may first be shaken out. Where additional subchambers 43 are configured to facilitate self-inflation, the user inflates them (and closes associated valve), thereby extending the mattress. This allows the free entry of air or other liquid into the enclosed mattress chamber 7 thereby allowing expansion of the resilient inflation/displacement control modules from their compressed (collapsed) condition. This expansion of the modules forces apart the bottom and top covers 1 and 2. When the mattress is fully expanded, the valve 4 is closed to retain the mattress in the inflated mode.

When the user is ready to stow the mattress, the valve 4 is opened (if provided, subchamber(s) 43 is also opened). The mattress then is rolled or folded in the direction of the valve 4, forcing air or liquid out of the mattress. When the mattress has been completely rolled or folded, the valve 4 is closed which helps to maintain the mattress in the rolled or folded state.

Figure 5:
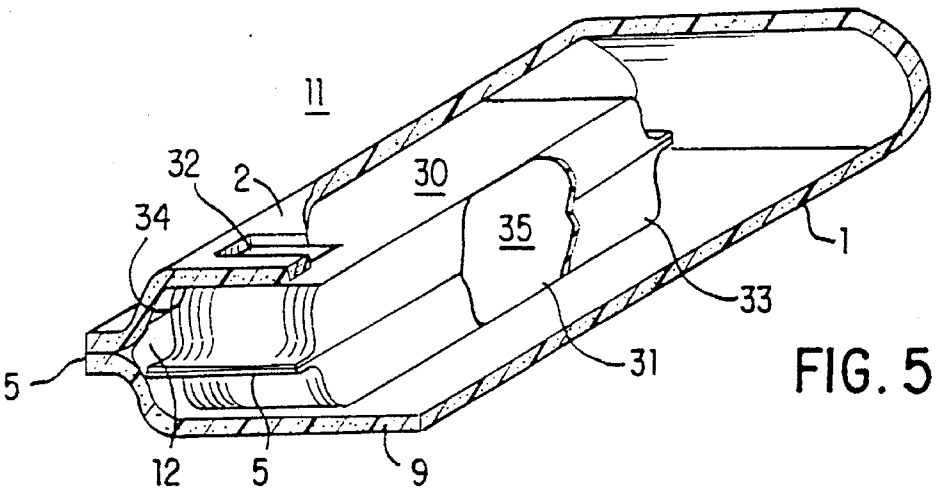
FIG. 5 shows an optional pressure/comfort control assembly.

The optional pressure control chamber 30 presented in FIG. 5 is a subchamber located within the main mattress chamber 7. Alternatively, it could be configured as a separate external chamber linked to the main mattress chamber 7. Where multiple mattress chambers are configured, pressure control chambers may be within any one, or more, of the chambers. The chamber's shell 33 may be constructed of any flexible air-impervious material such as coated nylon, rubberized fabrics, polyethylene film or the like. The surface of this chamber having an opening 32 may be bonded to the inside 9 of one of the covers. One or more of the opening(s) 32 between the interior of the chamber 35 and the outside atmosphere 11 is provided within this bonded area. The chamber 30 is filled with a resilient material 31. The chamber 30 is structured to enable the user to select the quantity and resilience of the material 31 to reflect the user's weight and comfort preferences and then insert it into the chamber 30. Resilience characteristics may be consistent throughout the chamber(s) or varied to increase resistance to compression as the pressure increases. After filling the chamber 31, the opening(s) 32 is partially closed to retain the resilient material 31 but allow continued air exchange between the chamber 30 and the atmosphere 11. This chamber serves dual purposes. First, it minimizes the effect of sudden localized loads placed on the mattress, through compression of the chamber which allows relief of moderate overpressure conditions. An added benefit of the chamber 30 is to assist in maximizing user comfort. When the user reclines on the mattress, pressure points are created at several locations along the body's contact area with the mattress. Further, the number and size of these pressure points varies with the position of the user (lying on the back, side, or stomach). The pressure points are somewhat relieved by the compression of the fluid within the mattress and the localized deflection of the mattress cover. This response can be optimized by varying the quantity of fluid within the mattress for selected weight disposition profiles. This response can be optimized for one body position but not simultaneously for all positions. The chamber 30 assists this effect by allowing additional controlled pressure relief when the user changes positions.

If additional insulation value and/or comfort is desired, at least one thin lightweight air-impervious sheet 50 may be configured within the main mattress chamber 7 enclosed by covers 1 and 2 in a manner such that it substantially extends to the edges 8 of the enclosure, or extends to an inside cover surface 9 in the area between the edge 8 and the module(s) 3 closest to the edge. Optionally the sheet 50 may be attached in such a fashion as to create two separate chambers. The inflation/displacement control modules are split into upper and lower components and bonded to the sheet 50. When each chamber is provided with its own valve assembly, the user may inflate the two chambers to provide different levels of support. For instance, the bottom chamber could be inflated to provide very firm support while the top is inflated to provide moderate support. The sheet 50 should be positioned so that when the enclosure is inflated and is in use, except for any point(s) where it is attached to the edge(s) 8 of the enclosure, points of contact with cover surfaces 1 or 2 are minimized to reduce heat losses through conduction. Appropriate materials for use as the sheet 50 include but are not limited to heat reflective metallized plastic films such as aluminized Mylar, flexible plastic films of polyethylene or the like, or coated fabrics.

Figure 9:
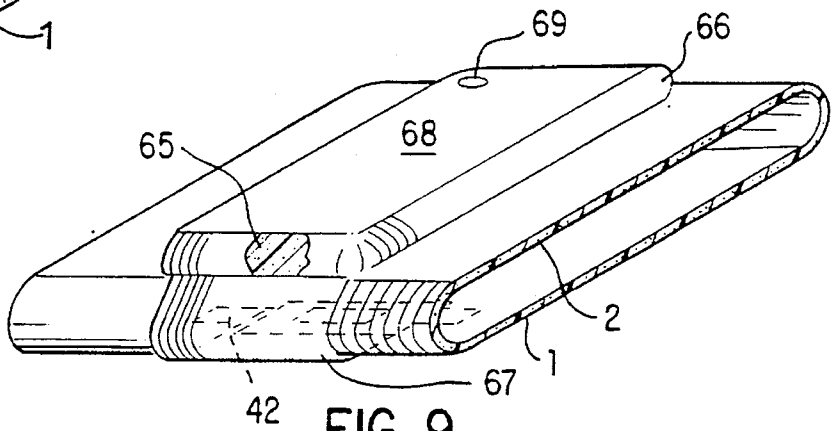
FIG. 9 shows an optional movable, adjustable resilient lumbar support pad with the mattress of the invention.

FIG. 9 shows an optional external lumbar support pad assembly 68. The cover 66 may be formed in the same way as a mattress 6 from a tube with sealed ends or from two sheets joined around their edges to form an air-tight envelope. Part of this cover 67 extends under the primary mattress chamber. Attachment means 42, such as Velcro, ties, or snaps is provided to attach this assembly to the bottom 1 of the mattress. This attachment enables the user to relocate the lumbar support pad assembly to suit his/her individual preferences. Resilient materials 65 are contained within this lumbar support pad envelope. The overall thickness of the pad may be approximately 0.5 to 1.5 inches. A valve 69 may be provided to enable the user to alter the amount of air contained within the lumbar pad envelope 68. As with the pressure control chamber 30, this lumbar support pad assembly 68 may be configured to provide for user selection (and fill) of resilient materials 65. To use the lumbar assembly, the user first determines the optimal placement of the assembly to suit personal preference. The assembly is then attached at the appropriate locations using attachment points 42. Alternately, the lumbar pad could be configured so as to attach to the user and turn with the user. Valve assembly 4 is opened to enable inflation of the assembly. If desired, the user may close valve 4 to maintain the inflation when the user reclines upon the lumbar assembly. As with the main mattress, the user may press some of the air out or add additional air prior to closure of the valve. Other uses such as a seat cushion augmentation are also applicable.

I claim:

1. An inflatable enclosure having first and second broad surfaces connected at their edges to form the enclosure, the first surface being formed of a substantially air-impermeable resilient closed-cell foam wherein the thickness and density of the closed-cell foam has been selected to provide semi-rigid characteristics between adjacent points of support and the second surface being formed of material selected from an air-impermeable resilient closed-cell foams and a flexible air-impervious material, said first surface being connected around its edges to a flexible air-impervious material which is in turn attached around the edges of the second surface to form the enclosure, the enclosure having at least one closable means for admitting a fluid to and releasing fluid from the enclosure.

2. The enclosure of claim 1 in which the second surface is a substantially air-impermeable resilient closed-cell foam.

3. The enclosure of claim 1 in which the second surface is a flexible air-impervious material.

4. The enclosure of claim 3 in which the material attached around the edges of the first surface is the edges of the second surface.

5. The enclosure of claim 1 which comprises at least one chamber formed by a second enclosure made of a substantially air-impermeable flexible material within said enclosure; said second enclosure being capable of being filled with air and having closable means to exchange air with the ambient atmosphere.

6. An inflatable enclosure having first and second broad surfaces connected at their edges to form the enclosure the first surface being formed of a substantially air-impermeable resilient closed-cell foam wherein the thickness and density of the closed-cell foam has been selected to provide semi-rigid characteristics between adjacent points of support and the second surface being formed of material selected from an air-impermeable resilient closed-cell foam and a flexible air-impervious material, said first surface being connected around its edges to a flexible air-impervious material which is in turn attached around the edges of the second surface to form the enclosure, said enclosure containing a plurality of compressible resilient units attached to opposite points of the inside of the first surface and the inside of the second surface of the enclosure (a) to cause self-inflation of the enclosure when air or another fluid is admitted to the collapsed enclosure; and (b) to substantially reduce billowing when a weight is placed on the inflated enclosure;

the enclosure having at least one closable means for admitting a fluid to and releasing fluid from the enclosure.

7. The enclosure of claim 6 in which the second surface is formed of a substantially air-impermeable resilient closed-cell foam.

8. The enclosure of claim 6 in which the second surface is formed of a flexible air-impervious material.

9. The enclosure of claim 6 wherein at least one thin sheet of a flexible material is positioned within the enclosure in such a manner that any unattached surfaces of said sheet will be from about 0.1 inch to about 1 inch removed from the inner surface of the enclosure and from any additional such sheets when the enclosure is inflated.

10. The enclosure of claim 6 wherein the sheet of material is supported by the compressible resilient units which are bonded to the inner surfaces of the enclosure.

11. The enclosure of claim 6 which comprises at least one chamber formed by a second enclosure made of a substantially air-impermeable flexible material within said enclosure; said second enclosure being capable of being filled with air and having closable means to exchange air with the ambient atmosphere.

12. The enclosure of claim 6 wherein the compressible resilient units in a region of the enclosure are longer than other such units to form an elevated pillow area on the enclosure.

* * * * *